US008479659B2

(12) United States Patent
López Gómez

(10) Patent No.: US 8,479,659 B2
(45) Date of Patent: Jul. 9, 2013

(54) DEVICES FOR MOVING THE BUFFERS OF ARTICULATED CARS OF RAILWAY VEHICLES TRAVELLING ON A CURVE

(75) Inventor: José Luis López Gómez, Madrid (ES)

(73) Assignee: Patentes Talgo, S.L., Madrid (ES)

( * ) Notice: Subject to any disclaimer, the term of this patent is extended or adjusted under 35 U.S.C. 154(b) by 241 days.

(21) Appl. No.: 13/054,640

(22) PCT Filed: Jul. 22, 2009

(86) PCT No.: PCT/ES2009/070300

§ 371 (c)(1),
(2), (4) Date: Apr. 12, 2011

(87) PCT Pub. No.: WO2010/010221

PCT Pub. Date: Jan. 28, 2010

(65) Prior Publication Data

US 2011/0185938 A1 Aug. 4, 2011

(30) Foreign Application Priority Data

Jul. 22, 2008 (ES) ..... 200802171

(51) Int. Cl.
*B61D 3/10* (2006.01)
*B61D 17/00* (2006.01)

(52) U.S. Cl.
USPC ..... 105/171

(58) Field of Classification Search
USPC ..... 105/3, 4.1, 4.4, 171, 453
See application file for complete search history.

(56) References Cited

U.S. PATENT DOCUMENTS

| | | | | |
|---|---|---|---|---|
| 2,874,647 | A | 2/1959 | Candlin, Jr. | |
| 4,625,652 | A * | 12/1986 | Losa et al. | 105/4.1 |
| 2011/0297036 | A1 * | 12/2011 | Lopez Gomez | 105/199.2 |

FOREIGN PATENT DOCUMENTS

| | | | |
|---|---|---|---|
| CH | 358 464 | A | 11/1961 |
| GB | 15402 | A | 0/1910 |
| WO | 82/00120 | A | 1/1982 |

* cited by examiner

*Primary Examiner* — S. Joseph Morano
*Assistant Examiner* — Zachary Kuhfuss
(74) *Attorney, Agent, or Firm* — Ladas & Parry LLP

(57) ABSTRACT

The invention relates to devices for moving the buffers of articulated cars of railway vehicles travelling on a curve. The devices are disposed between two adjoining cars (6, 6') articulated by a transversely centered coupling or linkage (12), said cars (6, 6') including a front-end projecting element (9) which is joined to the coupling or linkage (12) extending from the rear end of the next car. In all embodiments of the invention, as the buffers (3) move sideways under the action of skids (2) or other means towards the center of the curve at the part of the device closest to the wheels (7) on the inner part of the curve, the sideways movement of the car into the curve is limited as the buffers (3) come into contact with the corresponding surface of the wheel set, obstructing the sideways movement of the car.

9 Claims, 12 Drawing Sheets

Prior Art

DEVICES FOR MOVING THE BUFFERS OF ARTICULATED CARS OF RAILWAY VEHICLES TRAVELLING ON A CURVE

FIELD OF THE INVENTION

The present invention relates to devices for shifting the stops of the articulated railway cars or wagons when negotiating a curve.

BACKGROUND OF THE INVENTION

The applicant has developed various mechanical systems relating to the wheels and cars of railway vehicles to improve their safety and comfort.

In fact, the applicant has developed guiding systems for the wheels of wagons for railway vehicles in several of his patents. Thus, for example, the zero angle guiding system is described in Spanish patent 200131 ("Sistema guiado de pares de ruedas" (*Guiding System for Pairs of Wheels*)), and the negative angle guiding system in Spanish patent 194612 ("Suspensión para trenes ligeros con rodal sencillo" (*Suspension for Light Rails with a Simple Wheelset*)). By means of these systems, the risk of derailing in curves is prevented, guiding the wheels such that when running on a curve at a high speed the outer wheels strike the track with a nil or negative angle of incidence which tends to hold the wheel in the rail.

In the zero angle guiding system, the wheel is parallel to the tangent to the curve in the point of contact, whereas in the negative angle guiding system, a small angle is formed in curves.

These guidance systems for the wheels are applied to articulated trains made up of cars or wagons pivoted to one another at their ends and which are supported at the ends by a pair of wheels or by a pair of bogies.

On the other hand, when mobile ones run on a curved path or track, they are in general naturally subjected to a lateral push toward the outside thereof (due to centrifugal force) which, in the case of railway vehicles, translates into a tendency to roll over toward the outside and into a turning of the cars in the same direction. With the antiroll-type suspension developed by the applicant for the Talgo Pendular family of trains (which is described, for example, in his Spanish patent 424615, "Sistema de suspensión pendular" (*Antiroll Suspension System*)), the direction of this turning could be reversed such that in these trains, when the cars of the vehicles run on curves, they tilt naturally "toward the inside" of the curves. This allows considerably reducing the lateral force to which people who are inside the cars of the vehicles are inevitably subjected when traveling on curves.

The cars have a certain lateral clearance with respect to the wheelset comprising the wheels; in order to prevent them from coming out when movements due to lateral forces are experienced (for example, when traveling on a curve), side stops are placed which limit the lateral movement of the car, or relative movement with respect to its wheels.

In antiroll-type suspension, when running on a curve at a low speed, the centrifugal force is very small and does not compensate for the natural movement natural toward the inside of the curve which is typical of said suspension, therefore in practice the shifting of the car is toward the inside of the curve. The lateral shifting of the car toward the inside of the curve must be taken into account when designing the dimensions of the car, such that it can comply with the required outer gauge and thus enable its circulation without any interference. This means that for practical purposes, the width of the wagons can be reduced.

SUMMARY OF THE INVENTION

Thus, the object of the present invention is to provide devices for shifting the stops of articulated cars of a railway vehicle in curves which reduces the lateral shifting of the car toward the inside of the curve with respect to the wheel assembly and, therefore, which allows designing wider cars.

The invention provides a device for shifting the stops of articulated cars of railway vehicles in curves, which device is arranged between every two contiguous cars articulated by means of a transversely centered coupling or articulation, the cars having a protruding element protruding from their front part connected to the coupling or articulation projecting from the rear part of the preceding car, in which the preceding car has two supports fixed to its bed and close to its rear contour symmetrically with respect to the longitudinal axis of said car, from which corresponding ties emerge backwardly, which ties are articulated at one end on said supports and at the other end are connected to respective slides by means of respective articulations located at one end of each of said slides, the slides being able to shift on guides located in the respective lateral faces of the protruding element of the other car connected to the coupling or articulation; the following car has two supports fixed to its bed and close to its front contour symmetrically with respect to the longitudinal axis of said car, from which corresponding ties emerge forwardly, which ties are articulated at one end on said supports and at the other end are connected to respective support parts by means of respective articulations, each of the parts having a protruding stop on its outer face; and the support parts and the slides are wedge-shaped, such that the inclined plane corresponding to the inner face of each support part is coupled, such that it can shift, to a guide located in the inclined plane corresponding to the outer face of the corresponding slide.

A device for shifting the stops of articulated cars of railway vehicles in curves is also provided, which device is arranged between every two contiguous cars articulated by means of a transversely centered coupling or articulation, the cars having a protruding element protruding from their front part connected to the coupling or articulation projecting from the rear part of the preceding car, in which the preceding car has two supports fixed to its bed and close to its rear contour symmetrically with respect to the longitudinal axis of said car, from which corresponding ties emerge backwardly, which ties are articulated at one end on said supports and at the other end are connected to respective slides by means of respective articulations located at one end of each of said slides, the slides being able to shift on guides located in the respective lateral faces of the protruding element of the other car connected to the coupling or articulation; in which the following car has two supports fixed to its bed and close to its front contour symmetrically with respect to the longitudinal axis of said car, from which corresponding ties emerge forwardly, which ties are articulated at one end on said supports and at the other end are connected to respective support parts by means of respective articulations, each of the parts having a protruding stop on its outer face and elastic means connecting each support part with the corresponding lateral face of the protrusion of the car; and in which the support parts have an inner face in the form of an inclined plane and the slides are wedge-shaped with their outer face having the same inclination as that of the inner face of the support part, such that the inclined plane corresponding to the inner face of each support part is coupled to a guide located in the inclined plane of the outer face of the corresponding slide, such that each slide can shift along the inclined plane of the inner face of the respective support part.

A device for shifting the stops of articulated cars of railway vehicles in curves is also provided, which device is arranged between every two contiguous cars articulated by means of a transversely centered coupling or articulation, the cars having a protruding element protruding from their front part connected to the coupling or articulation projecting from the rear part of the preceding car, in which the preceding car has two rods integral therewith and projecting from its rear part symmetrically with respect to its longitudinal axis; on the respective lateral faces of the protruding element there are respective wedge-shaped slides able to shift on guides located in said lateral faces, said lateral faces comprising an end stop for the slide, each slide being supported by one of its end surfaces on an elastic means which is connected to the front edge of the following car; on the respective lateral faces of the protruding element there are respective support parts fixed to said faces, each of said support parts with an opening on its outer face housing a stop able to shift transversely, the inner surface of the stop having an inclination corresponding to that of the inclined plane of the outer surface of the wedge-shaped slide, the slides being able to shift inside the corresponding support parts; and in which the rods have a length such that, when the preceding and following cars are aligned, said rods make contact on the corresponding end faces of the slides.

By means of these configurations, it is achieved that the stops can shift toward the inside of the curve when the preceding car enters a curve, thus limiting the lateral shifting of said car toward the inside of the curve when entering the curve at a low speed.

Another advantage of the device of the invention is that since it allows designing wider cars, the passenger has more space inside the inner compartment.

Other features and advantages of the present invention will be understood from the following detailed description of several illustrative embodiments of its object in relation to the attached figures.

DETAILED DESCRIPTION OF THE INVENTION

Figure 1:
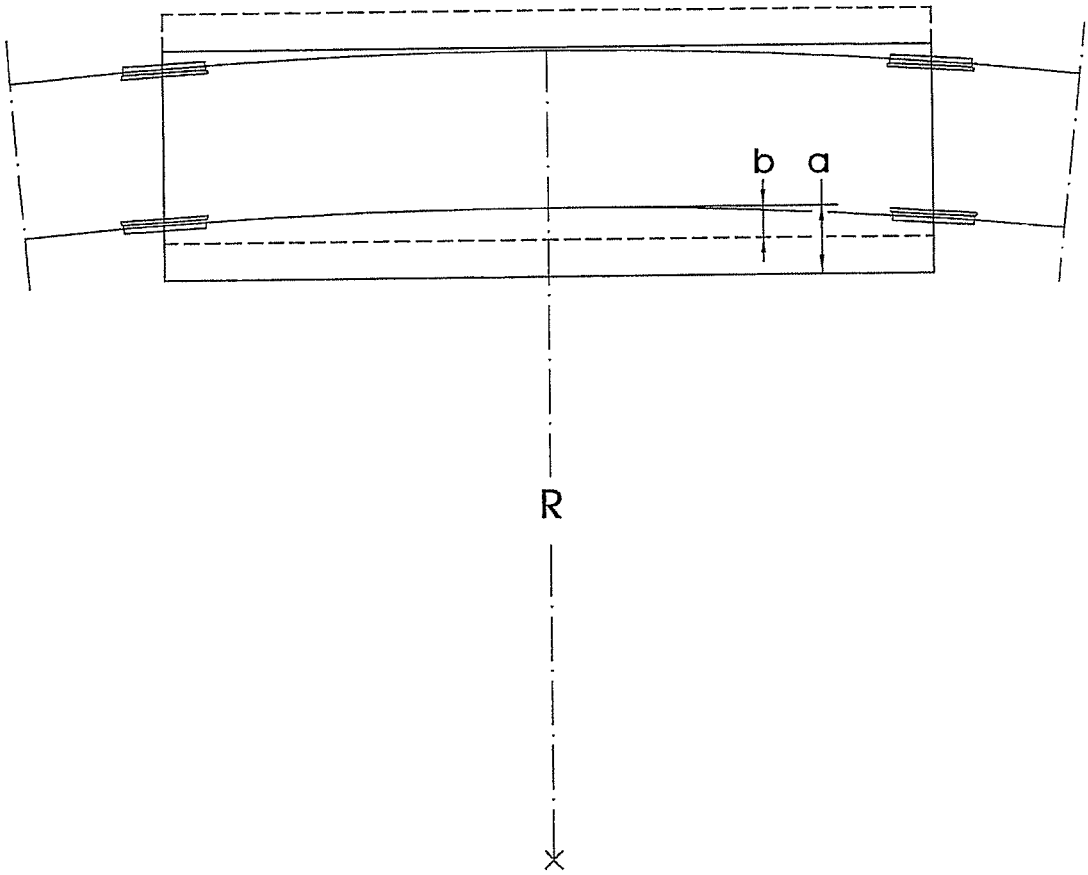
FIG. 1 schematically shows a plan view of a car or wagon of an articulated railway vehicle when it is running on a curve at a low speed.

FIG. 1 depicts a very schematic plan view of a car or wagon of an articulated railway vehicle on a curved track, when it is traveling at a low speed; the relative position of the car with respect to the track has been exaggerated for illustrative purposes.

The position of the car when, due to the antiroll-type suspension, the car has shifted toward the inside of the curve is depicted with a solid line. If the lateral contour of the wagon located in the inner part of the curve was similar to a chord with a circumference of radius R (that corresponding to the curve of the inner rail) the distance indicated as "a" in the figure would be the distance of the chord to the arc of circumference, called sagitta. This distance (sagitta) limits the width of the car on the inner part of the curve.

Figure 2:
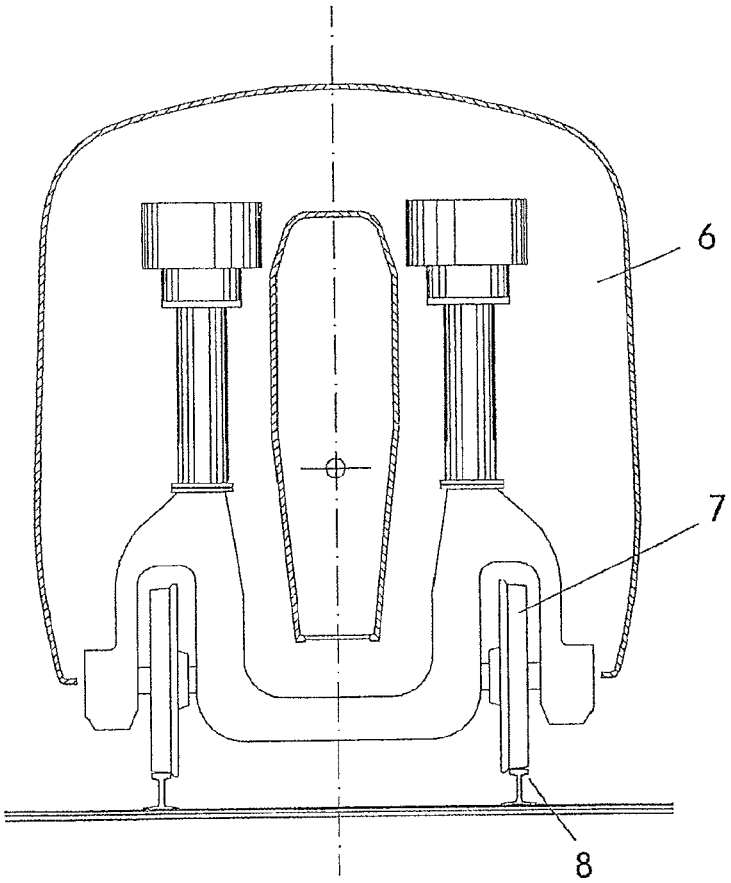
FIG. 2 shows a schematic cross section of a railway vehicle of the prior art.

The position of the car when the device of the present invention has been implemented for shifting the stops of the articulated railway cars or wagons when it is entering a curve is depicted with a dotted line (similarly, said position has been exaggerated). As can be seen, the lateral contour of the wagon located in the inner part of the curve is maintained closer to the inner rail and the lateral contour of the wagon located in the outer part of the curve is somewhat separated from the outer rail. It is observed that in this case the new sagitta "b" is less than the sagitta "a" of the position in the solid line, since the distance "a" has been distributed on both the inner and outer sides of the curve. The outer gauge is thus reduced by the inner part of the curve, which in the previous situation was rather large FIG. 2 depicts a cross section of a railway vehicle of the prior art incorporating an antiroll-type suspension when it is running on a straight track, in which the car 6 of the vehicle and the wheelset with the corresponding wheels 7 on the rails 8 can be seen.

Figure 3A:
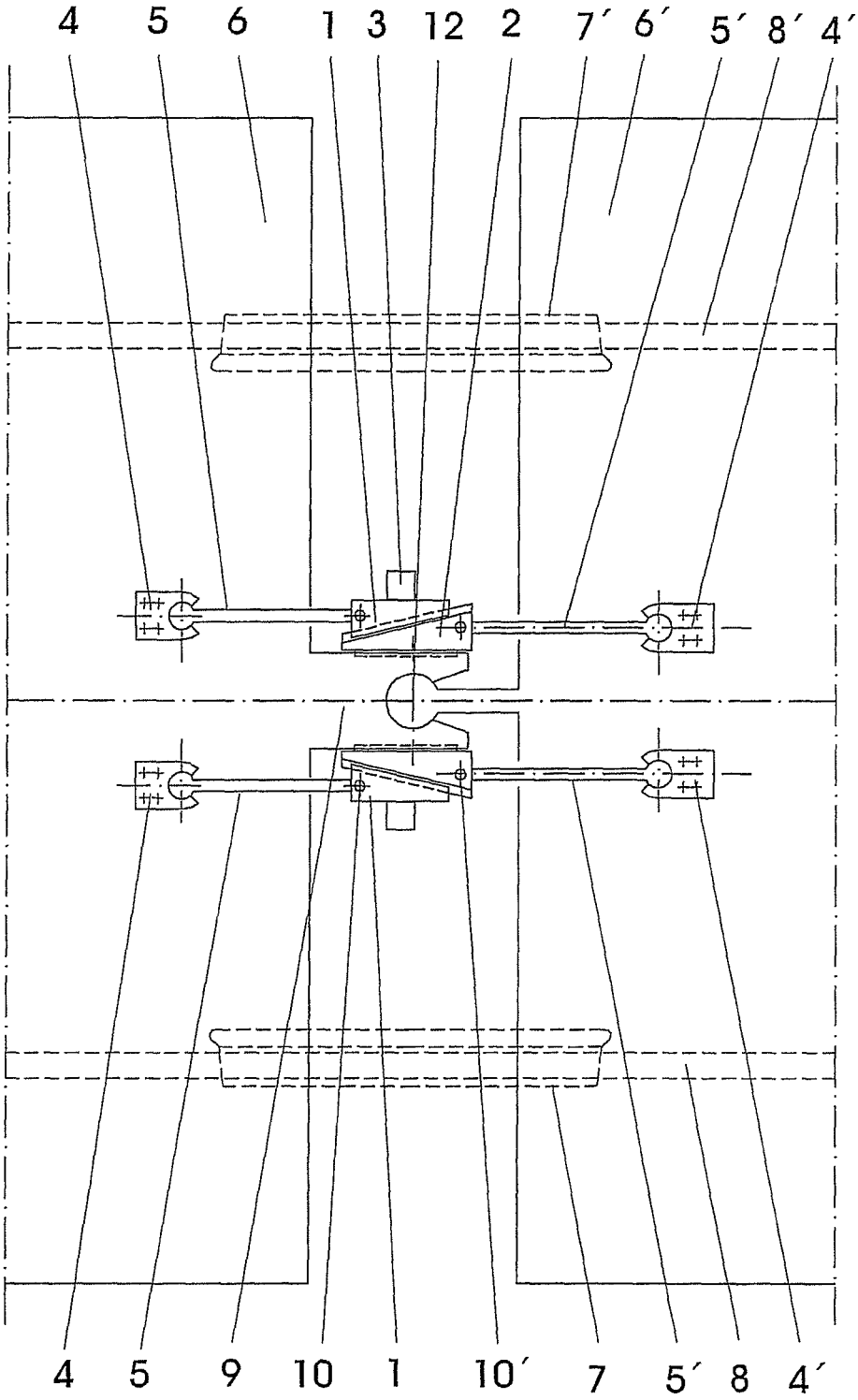
FIG. 3A shows an embodiment of the object of the invention incorporated between two cars or wagons of an articulated railway vehicle when running on straight tracks.
Figure 3B:
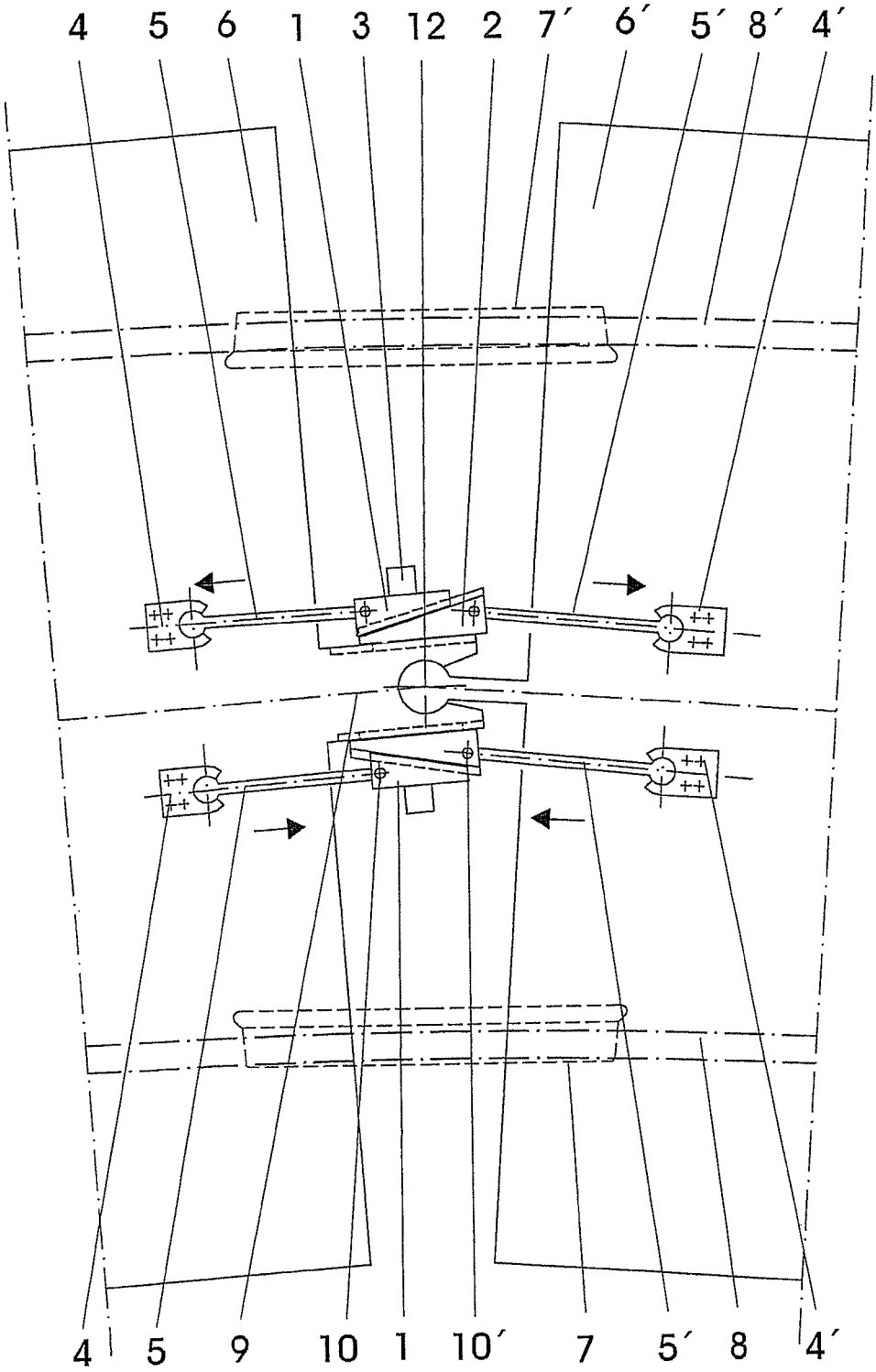
FIG. 3B shows the embodiment of FIG. 3A of the object of the invention when running on a curve at a low speed.

FIGS. 3A and 3B depict plan views of an embodiment of the device of the invention incorporated between two cars or wagons 6, 6" of an articulated railway vehicle, when running on straight tracks (FIG. 3A) and on curved tracks (FIG. 3B); although in all the figures in plan view, the direction of the course is toward the right (i.e., car 6' is the preceding car and car 6 is the following car), it is observed that the railway vehicle can run in both directions. It can be observed that the respective wheels 7, 7' are located on the rails 8, 8'; it is observed that the assembly can be provided with any guiding system for the wheels 7, 7' of those described in the prior art.

The cars 6, 6' are connected by means of a centered articulation 12 with coupling located in the vertical plane containing the axes of the wheels 7, 7'. In the device of the invention, a pair of supports 4 is fixed to the bed of the car 6, close to its front contour symmetrically with respect to the longitudinal axis of said car 6. Ties 5 can be observed, which ties 5 are articulated at one end on said supports 4 and at the other end are connected to respective wedge-shaped support parts 1 by means of respective articulations located at the end of each of said support parts 1. The stops 3 are located on the outer face of these support parts 1, projecting from said outer faces (i.e., parts 1 serve as a support for the stops 3).

In the right half of FIGS. 3A and 3B it is observed that a pair of supports 4' is fixed to the bed of the car 6', close to its rear contour and symmetrically with respect to the longitudinal axis of said car 6', and that furthermore there are ties 5' which are articulated at one end on said supports 4' and at the other end are connected to respective wedge-shaped slides 2 by means of respective articulations 10' located at the end of each of said slides 2. The slides 2 can slide on guides located in the respective lateral faces of the protruding element 9 of the car 6 connected to the coupling or articulation 12.

FIG. 3B shows the working of the device for shifting the stops 3 when traveling on a curve (depicted by the rails 8, 8', with a curvature in FIG. 3B). When entering or negotiating the curve, car 6' turns with respect to the car 6. In the part of the device closest to the wheel 7 located in the inner part of the curve, the distance between the articulations of the supports 4 and 4' is reduced, whereby the corresponding slide 2 turns with respect to its articulation 10' and shifts toward the left in the figure. In turn, the corresponding wedge-shaped support part 1 can also turn with respect to its articulation 10 and shift with relative movement on the slide 2 due to the tie 5 pushing the support part 1 by means of said articulation 10.

In the part of the device closest to the wheel 7' located in the outer part of the curve, the distance between the articulations of the supports 4 and 4' increases, whereby the slide 2 turns with respect to its articulation 10' and shifts toward the right in the figure. In turn, the respective wedge-shaped support part 1 can also turn with respect to its articulation 10 and shift toward the left on the respective slide 2.

By arranging the articulations 10 (at the end of each of the support parts 1) and 10' (at the end of each of the slides 2), the relative turning between cars 6, 6' is not blocked when traveling on the curve.

As has been seen, in this embodiment both stops 3 shift. The shifting of the stop 3 located in the inner part of the curve is the necessary shifting to prevent the car 6' from coming out of the gauge on the inside of the curve, since said stop 3 is integral with the support part 1 which can move on the guide of the slide 2, without being detached from it.

Figure 3C:
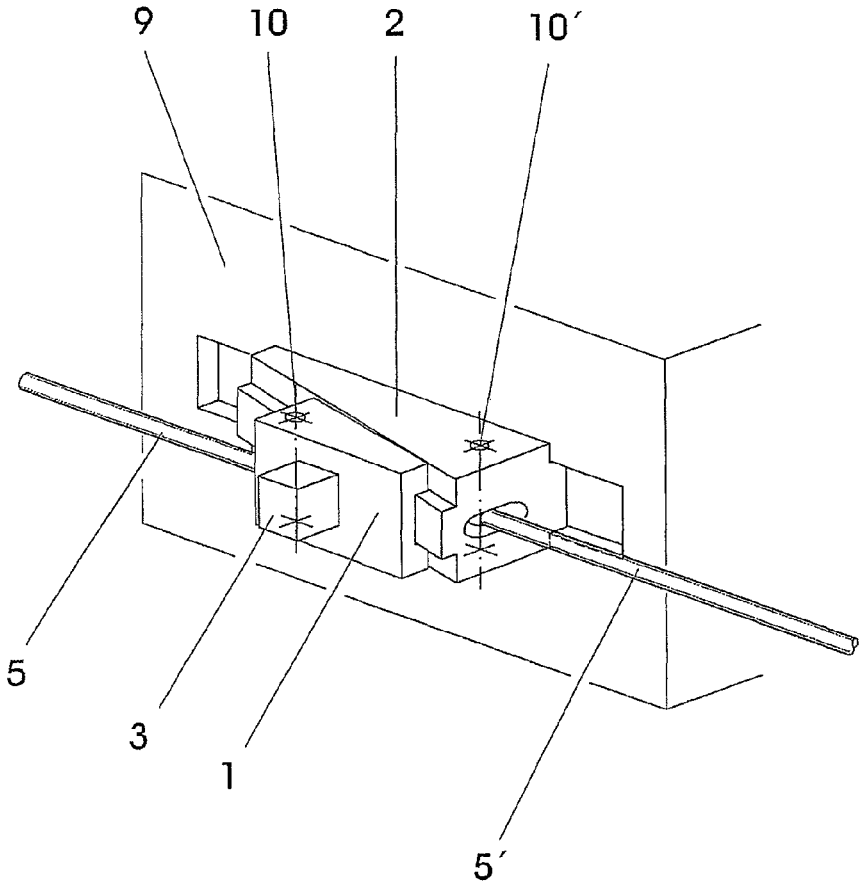
FIG. 3C shows a perspective view of a detail of the embodiment of the object of the invention of FIGS. 3A and 3B.

FIG. 3C depicts a perspective view of the assembly formed by the slide 2 and the support 1 with the respective stop 3, as well as the corresponding ties 5' and 5. It is observed that the slide 2 can slide on the respective lateral face of the protruding element 9 of the car 6.

Figure 4A:
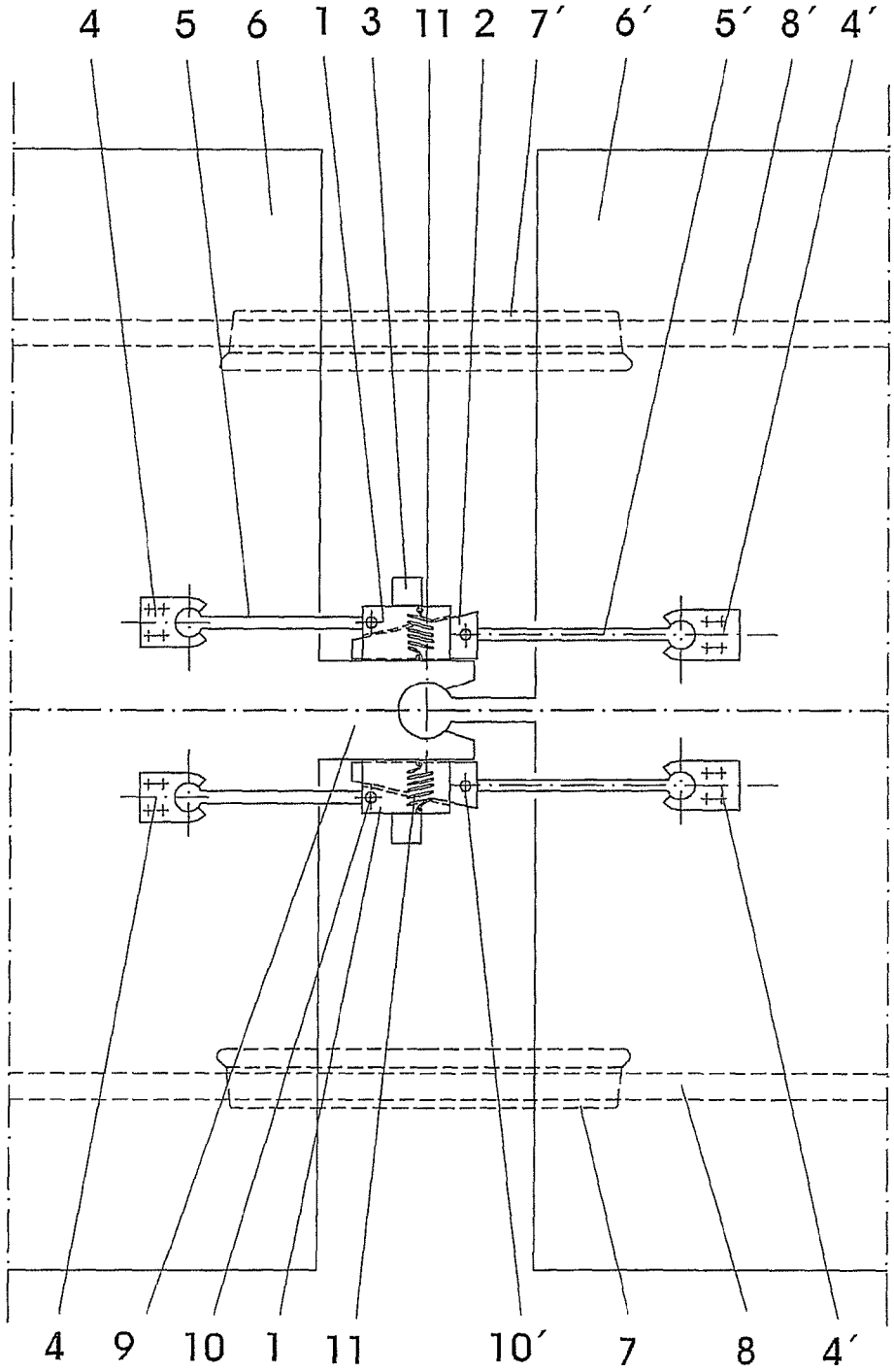
FIG. 4A shows another embodiment of the object of the invention incorporated between two cars or wagons of an articulated railway vehicle when running on straight tracks.
Figure 4B:
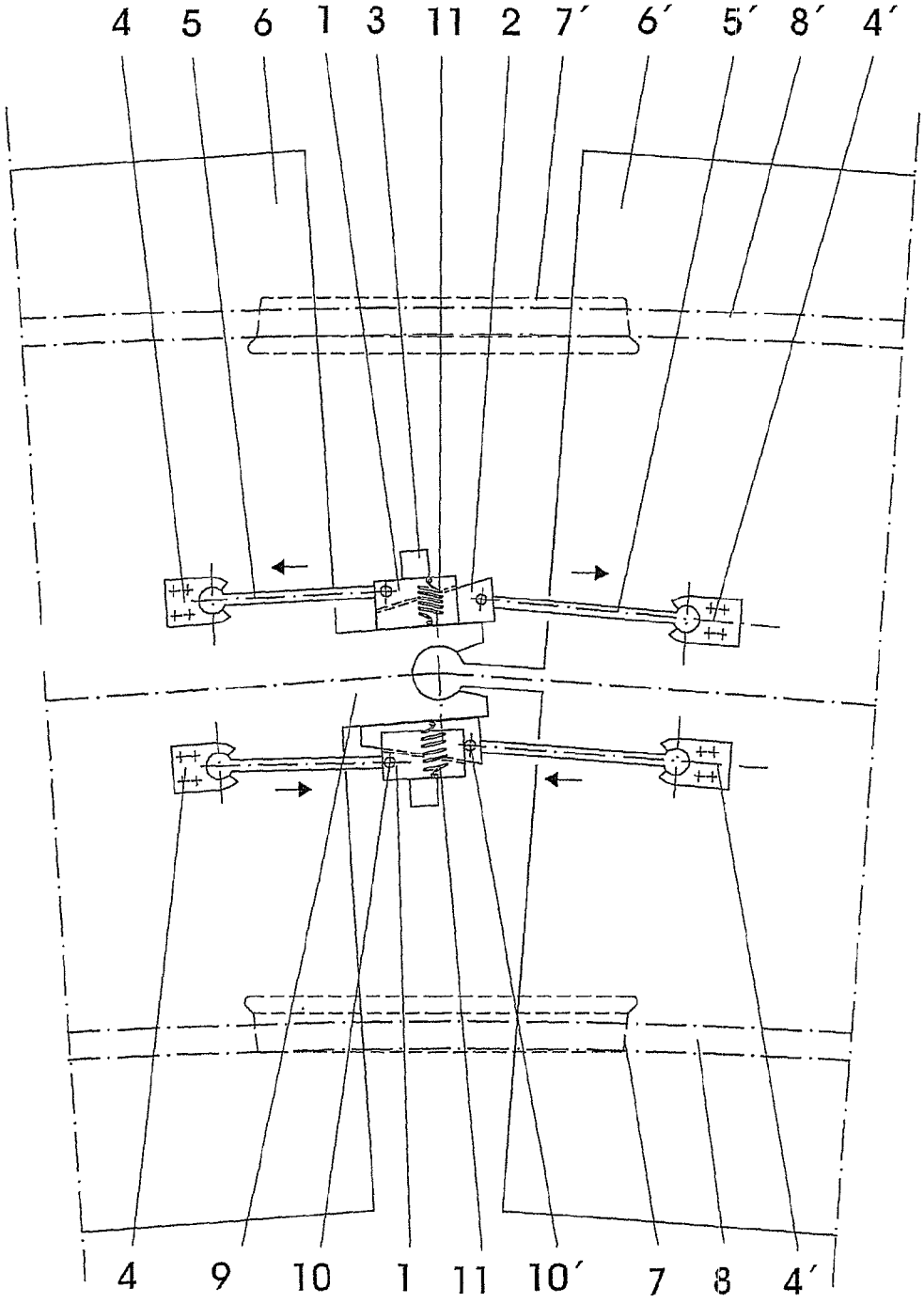
FIG. 4B shows the embodiment of FIG. 4A of the object of the invention when running on a curve at a low speed.
Figure 4C:
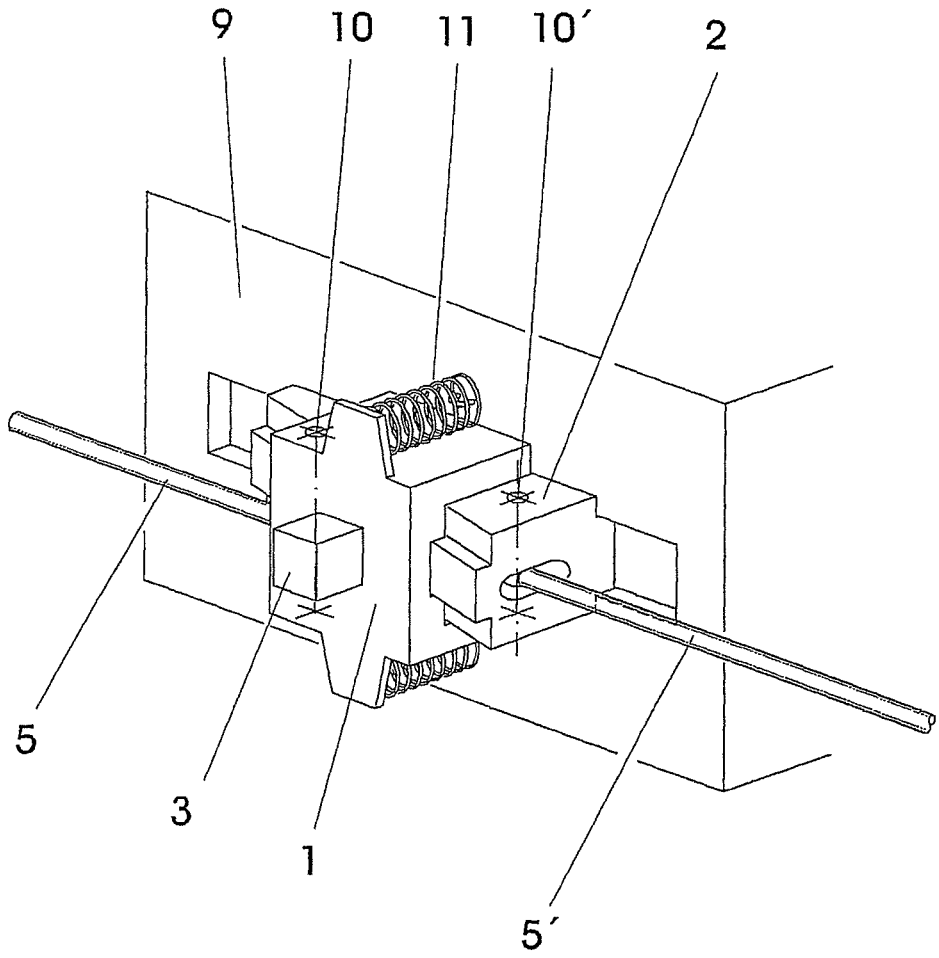
FIG. 4C shows a perspective view of a detail of the embodiment of the object of the invention of FIGS. 4A and 4B.

FIGS. 4A and 413 depict plan views of another embodiment of the device of the invention incorporated between two cars or wagons 6, 6' of an articulated railway vehicle when running on straight tracks (FIG. 4A) and on curved tracks (FIG. 4B). It is observed that the respective wheels 7, 7' are located on the rails 8, 8'; it is observed that the assembly can also be provided with any guiding system for the wheels 7, 7 of those described in the prior art. FIG. 4C shows a perspective view of a detail of the object of this embodiment.

The embodiment depicted in FIGS. 4A, 4B and 4C shows coincidences with that of FIGS. 3A, 3B and 3C. Thus, for example, the assemblies formed by the supports 4 and 4' and the respective ties 5 and 5' have the same configuration. Likewise, the ends of the ties 5 are connected to the support parts 1 by means of respective articulations 10 located at the end of each of said support parts 1, and the ends of the ties 5' are connected to the slides 2 by means of respective articulations 10' located at the end of each of said slides 2. These slides 2 can also slide on guides located in the respective lateral faces of the protruding element 9 of the car 6. The stops 3 project from the outer face of these support parts 1.

With regard to the differences between this embodiment and the preceding embodiment, FIGS. 4A, 4B and 4C show that the support parts 1 are not externally wedge-shaped (but rather U-shaped) and that they are connected to the respective lateral faces of the protruding element 9 of the car 6 by means of respective elastic means 11, preferably springs. Therefore, when the elastic means 11 are in their normal position (like in the situation of FIG. 4A), the parts 1 are supported on the corresponding lateral face of the protrusion 9 of the car 6.

FIG. 4B shows the working of the device for shifting the stops 3 when traveling on a curve (depicted by the rails 8, 8', with a curvature in FIG. 4B). When entering curves, car 6' turns with respect to car 6. In the part of the device closest to the wheel 7 located in the inner part of the curve, the distance between the articulations of the supports 4 and 4' is reduced, whereby the slide 2 turns with respect to its articulation 10 and shifts toward the left in the figure. In turn, the support part 1 can also turn with respect to its articulation 10. Since the support part 1 is not integral with the lateral face of the protrusion 9 of the car 6, due to the push it experiences toward the inside of the curve due to the action of the slide 2 on its inclined inner surface, said support part 1 (and therefore the corresponding stop 3) separates from the lateral face of the protrusion 9 of the car 6, causing the extension of the spring. The shifting of the stop 3 is thus a consequence of the radius of the curve, which makes the elastic means 11 stretch.

In the part of the device closest to the wheel 7' located in the outer part of the curve, the distance between the articulations of the supports 4 and 4' increases, whereby the slide 2 turns with respect to its articulation 10 and shifts toward the right in the figure; this makes the inclined inner surface of the support part 1 separate from the inclined outer surface of the wedge-shaped slide 2 (as depicted with the two inclined solid lines in FIG. 4B). In turn, the corresponding support part 1 remains connected to the lateral face of the protrusion 9 of the car 6 by the elastic means 11, which maintains the same tension as in the situation of FIG. 4A.

In this second embodiment, therefore, only the inner stop 3 separates from the lateral face of the protrusion 9 of the car 6, the outer stop 3 maintaining the same distance with respect to its respective lateral face of the protrusion 9 of the car 6.

The shifting of the stop 3 located in the inner part of the curve is the necessary shifting to prevent the car 6' from coming out of the gauge on the inside of the curve, since said stop 3 is integral with the support part 1 which can separate from the corresponding lateral face of the protrusion 9 of the car 6, being bound to it by the elastic means 11.

FIG. 4C depicts a perspective view of the assembly formed by the slide 2 and the support 1 with the respective stop 3, as well as the corresponding ties 5' and 5 and the elastic means 11. It is observed that the slide 2 can slide on the respective lateral face of the protruding element 9 of the car 6. The U-shape of the support part 1 is also seen in this FIG. 4C, the inner surface of which has an inclination corresponding to that of the outer surface of the slide 2, which is wedge-shaped and which, when shifting toward the left (FIG. 4B), pushes the support part 1 toward the inside of the curve, such that it separates from the corresponding lateral face of the protrusion 9 in the inner part of the curve.

Figure 5A:
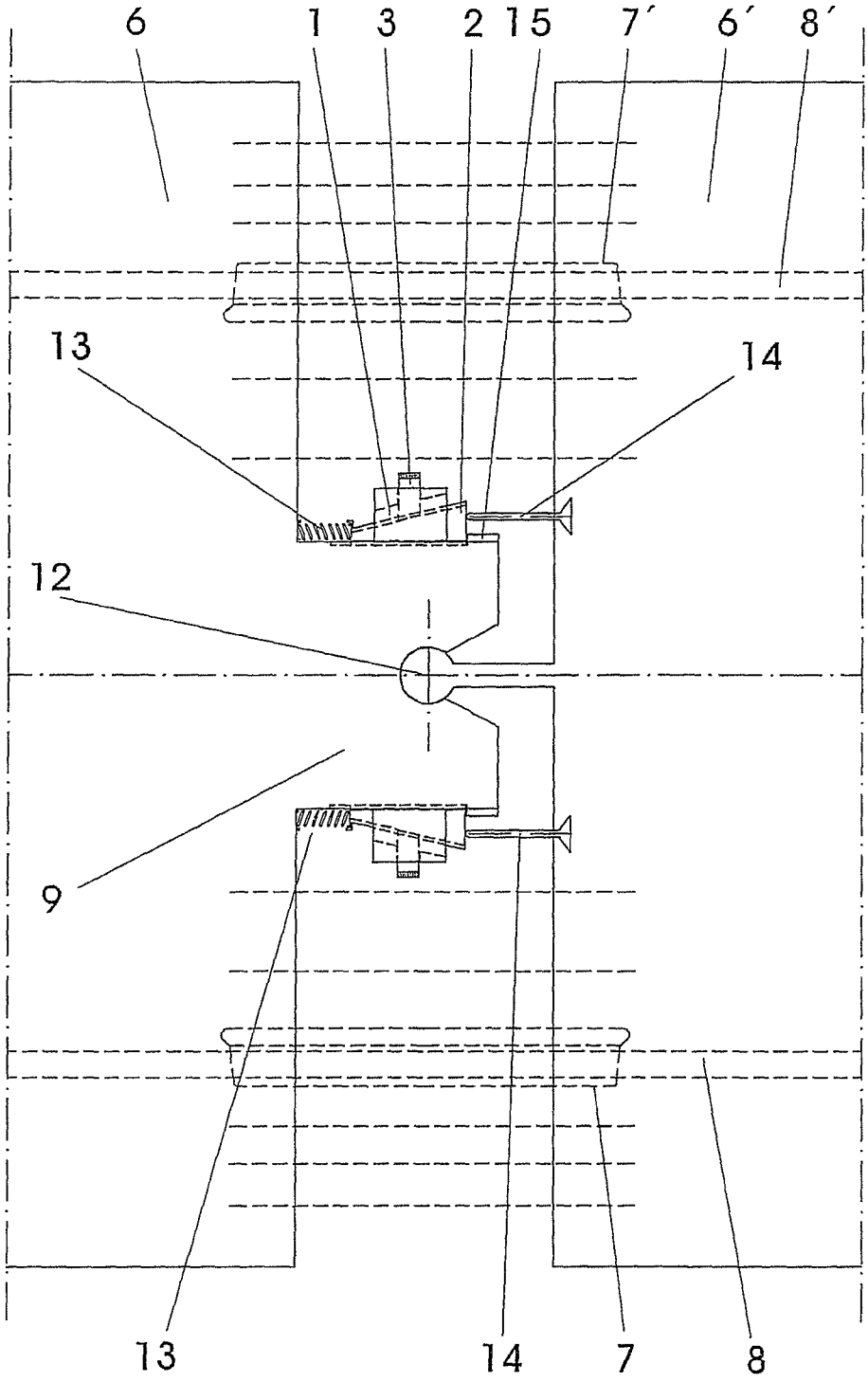
FIG. 5A shows another embodiment of the object of the invention incorporated between two cars or wagons of an articulated railway vehicle when running on straight tracks.
Figure 5B:
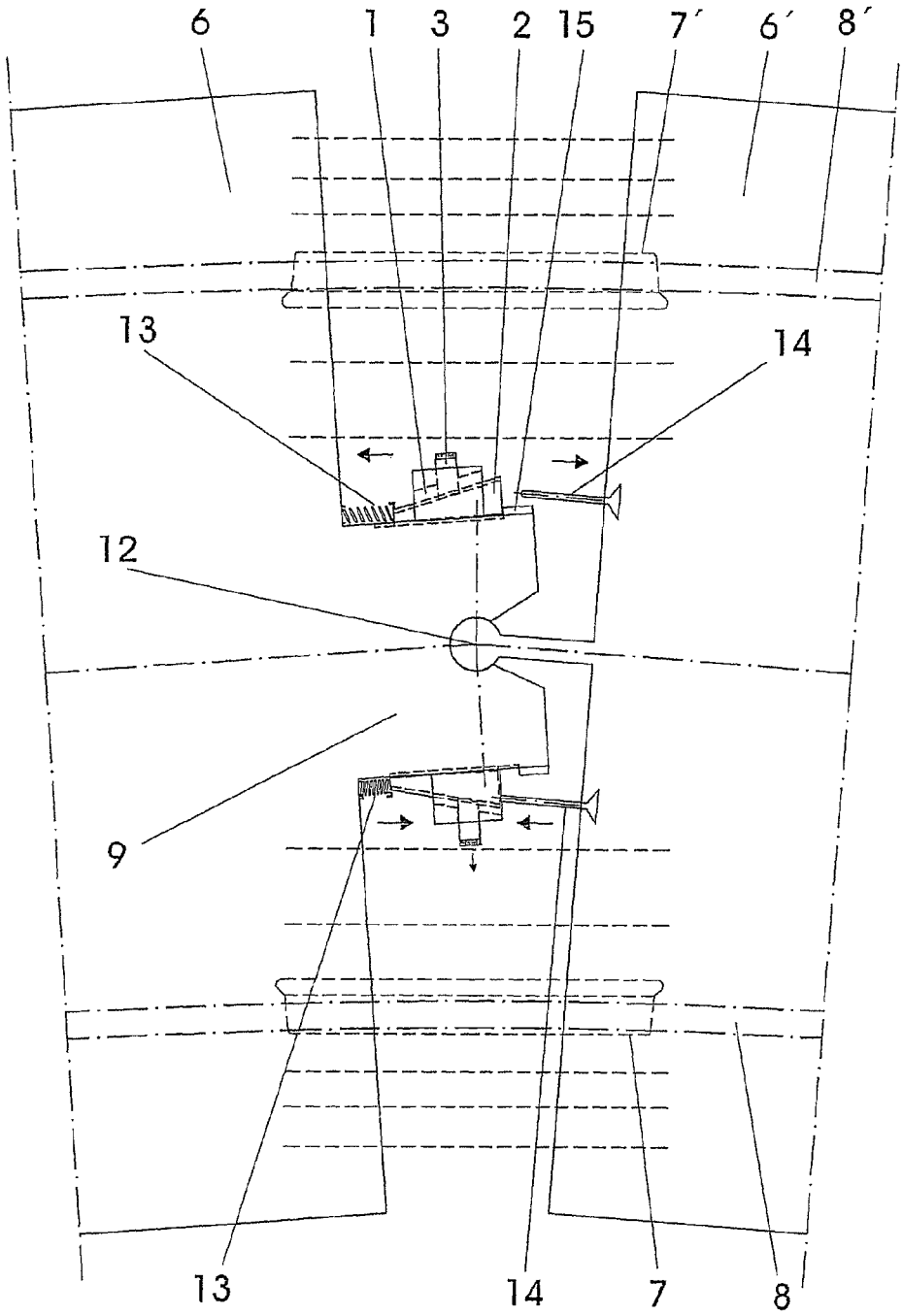
FIG. 5B shows the embodiment of FIG. 5A of the object of the invention when running on a curve at a low speed.
Figure 5C:
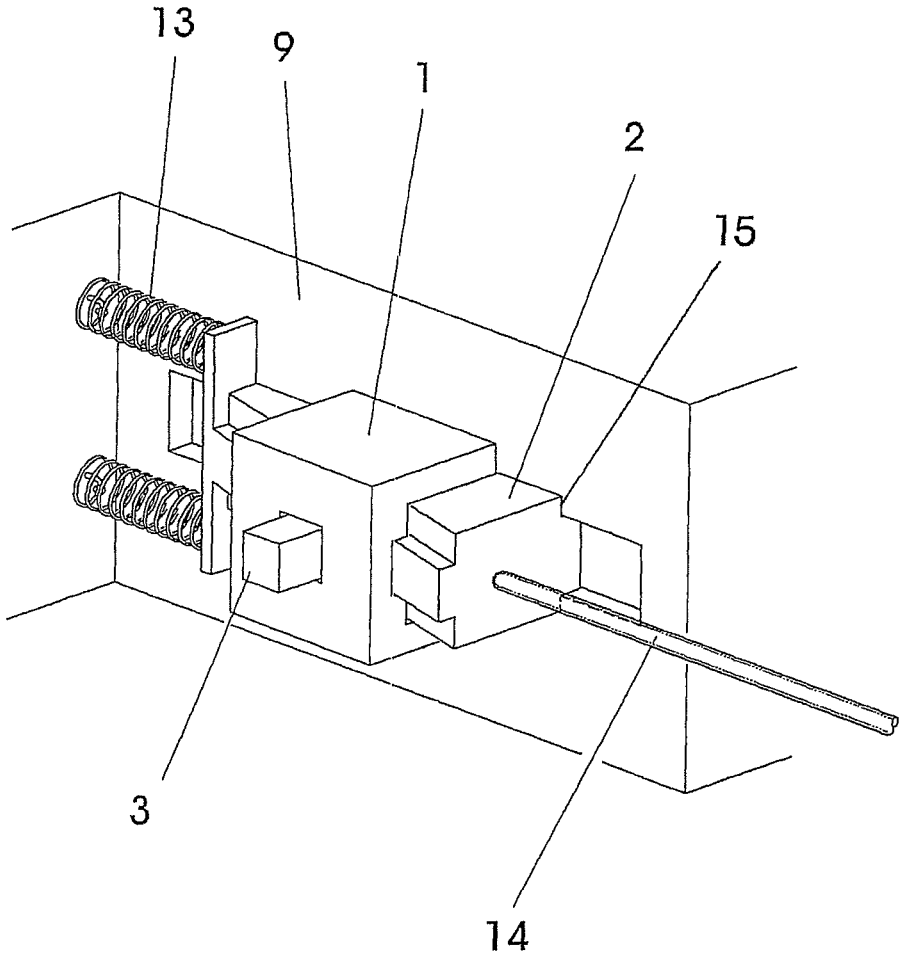
FIG. 5C shows a perspective view of a detail of the embodiment of the object of the invention of FIGS. 5A and 5B.
Figure 5D:
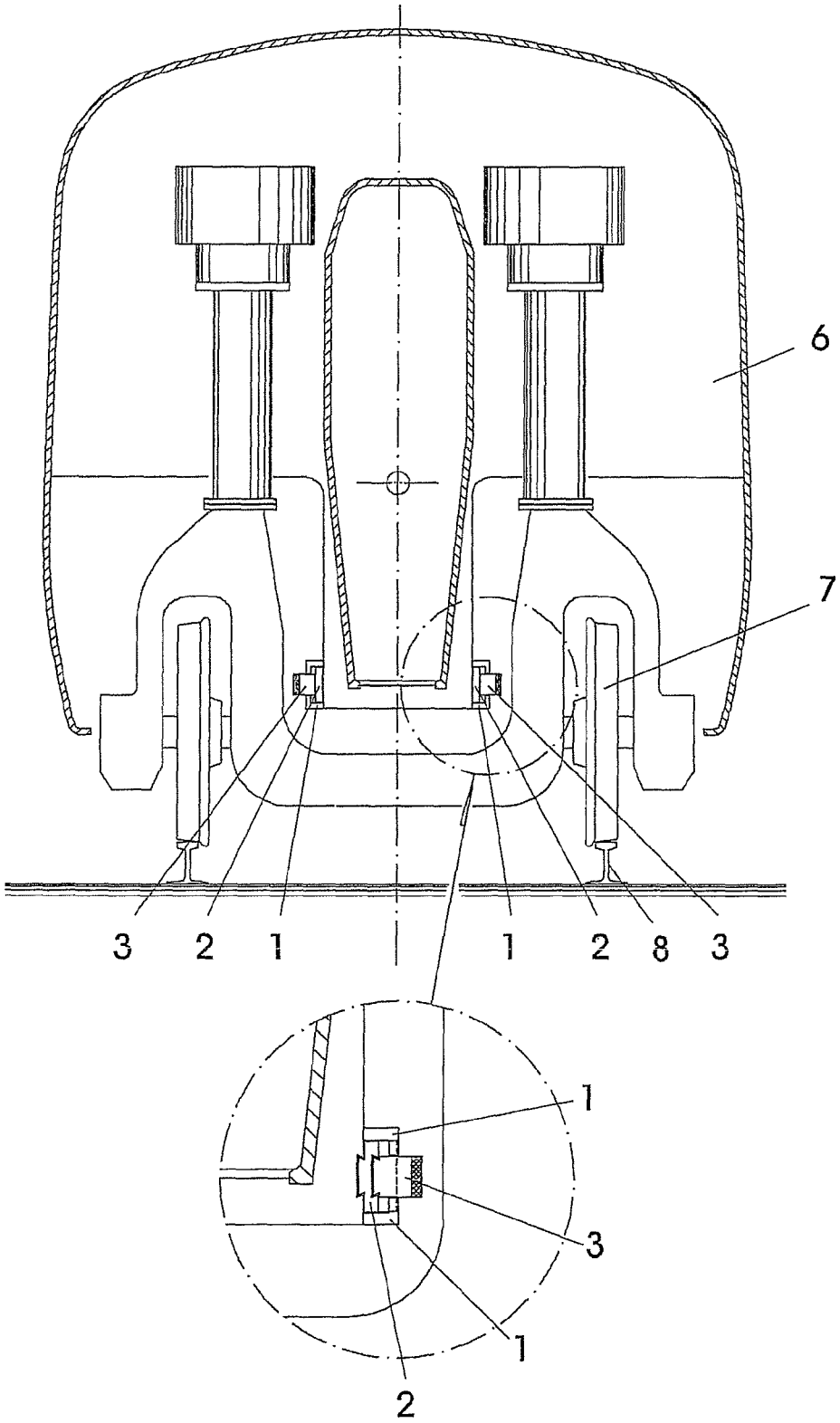
FIG. 5D shows a schematic cross section of a railway vehicle with the embodiment of the object of the invention of FIGS. 5A, 5B and 5C, and a detail of said cross section.

FIGS. 5A and 5B depict plan views of another embodiment of the device of the invention incorporated between two cars or wagons 6, 6' of an articulated railway vehicle when running on straight tracks (FIG. 5A) and on curved tracks (FIG. 5B). It is observed that the respective wheels 7, 7' are located on the rails 8, 8'; it is observed that the assembly can also be provided with any guiding system for the wheels 7, 7' of those described in the prior art. FIG. 5C shows a perspective view of a detail of the object of this embodiment and FIG. 5B shows a schematic cross section of a railway vehicle with the object of this embodiment and an enlargement of the part in which said object appears.

It is observed in said figures that the support parts 1 are fixed on the respective lateral face of the protruding element 9 of the car 6. Each support part 1 is U-shaped, with a guiding opening in its outer face through which the stop 3 comes out. The stop 3 is guided in the opening of the support part 1 such that it can shift transversely (i.e., in the direction perpendicular to the respective lateral face of the protruding element 9 of the car 6).

The slides 2 can slide on guides located in the respective lateral faces of the protruding element 9 of the car 6, which in FIGS. 5A, 5B and 5C have an end stop 15 limiting the shifting of said slides 2 toward the right according to said figures. These slides 2 are wedge-shaped, and their narrowest end face (the one located on the left in FIGS. 5A, 5B and 5C) is supported on an elastic means 13, preferably springs, which is connected to the front edge of the car 6. On the other hand, push rods 14 project from the rear part of the car 6', integral therewith, which rods, when the railway vehicle runs on a straight path, are in contact with the end face with the larger surface area (the one located on the right in FIGS. 5A, 5B and 5C) of the slides 2.

In FIG. 5A, it is observed that when running on a straight path, both in the part closest to the wheel 7 and in the part closest to the wheel 7', the corresponding elastic means 13 push the respective slides 2, which will be stopped in the stops 15. The push rods 14 make contact on the end face with the larger surface area of the slides 2.

The symmetrical arrangement of the elements of the device is also observed in this embodiment with respect to the longitudinal axes of the cars 6 and 6'.

FIG. 5B shows the working of the device for shifting the stops 3 when traveling on a curve (depicted by the rails 8, 8', with a curvature in FIG. 5B). When entering or negotiating the curve, car 6' turns with respect to car 6. In the part of the device closest to the wheel 7 located in the inner part of the curve, the rod 14 turns with car 6' and shifts toward the left, reducing its distance with respect to car 6.

Since the inner surface of the stop 3 has an inclination corresponding to that of the outer surface of the wedge-shaped slide 2, when the rod 14 shifts toward the left it pushes the slide 2, which makes the stop 3 protrude toward the inside of the curve, in the direction perpendicular to the respective lateral face of the protruding element 9 of the car 6.

The slides 2 shift inside the corresponding support parts 1, which in the embodiment shown in the figures are U-shaped.

The elastic means 13 protruding from the front edge of the car 6 in the part of the device closest to the wheel 7, and which is supported on the end face with a smaller surface area of the slide 2, is pushed and compressed by the slide 2 when it is traveling on the curve (as observed in FIG. 5B). When it returns to a straight stretch, the rod 14 stops pushing the slide 2, whereby the elastic means 13 return to their rest position and the stop 3 is inserted, returning to its original position (FIG. 5A). In turn, the slide 2 returns to its initial position, determined by the position of the stop 15.

In the part of the device closest to the wheel 7' located in the outer part of the curve, the corresponding rod 14 shifts toward the right when the railway vehicle travels on said curve, whereby separating from the slide 2. As in FIG. 5A, in this part of the device the corresponding elastic means 13 push the respective slide 2, which will be stopped in the stop 15. Therefore, the stop 3 of this part of the device does not project with respect to the position it had when the railway vehicle was running on a straight path (reference position).

The rods 14 have a length such that when the cars 6 and 6' are aligned (i.e., in a straight path), said rods 14 make contact on the corresponding end faces of the slides 2 (i.e., at the height of the end stops 15 of the slides 2).

In all the embodiments, when the lateral shifting of the stops 3 toward the inside of the curve in the part of the device closest to the wheels 7 occurs, the lateral shifting of the car toward the inside of the curve is limited since said stops 3 will contact with the corresponding surface of the wheelset, stopping said lateral shifting of the car.

Obviously, if the layout is of a curve symmetrical to the one depicted, the working would be the same due to the symmetry of the assembly for all the embodiments.

In the articulated system to which the device of the invention is applied, the point of coupling 12 between cars 6, 6' is centered in relation to the axis of the track (i.e., transversely centered).

Those modifications comprised within the scope defined by the following claims can be introduced in the preferred embodiments of the invention described above.

The invention claimed is:

1. A device for shifting the stops of articulated cars of railway vehicles in curves, which is arranged between every two contiguous cars articulated by means of a transversely centered coupling or articulation, the two contiguous cars being a preceding car and a following car and having a protruding element protruding from a front part connected to the coupling or articulation projecting from the rear part of the preceding car, wherein the preceding car has two supports fixed to its bed and close to its rear contour symmetrically with respect to the longitudinal axis of said preceding car, from which corresponding ties emerge backwardly, said ties are articulated at one end on said supports and at the other end are connected to respective slides by means of respective articulations located at one end of each of said slides, the slides being able to shift on guides located in respective lateral faces of the protruding element of a following car connected to the coupling or articulation;

the following car has two supports fixed to its bed and close to its front contour symmetrically with respect to the longitudinal axis of said car, from which corresponding ties emerge forwardly, which ties are articulated at one end on said supports and at the other end are connected to respective support parts by means of respective articulations, each of the support parts having a protruding stop on its outer face;

and the support parts and the slides are wedge-shaped, such that an inclined plane corresponding to the inner face of each support part is coupled, such that the support parts can shift, to a guide located in the inclined plane corresponding to the outer face of the corresponding slide.

2. A device for shifting the stops of articulated cars of railway vehicles in curves, which is arranged between every two contiguous cars articulated by means of a transversely centered coupling or articulation, the two contiguous cars being a preceding car and a following car and having a protruding element protruding from a front part connected to the coupling or articulation projecting from the rear part of the preceding car, wherein the preceding car has two supports fixed to its bed and close to its rear contour symmetrically with respect to the longitudinal axis of said preceding car, from which corresponding ties emerge backwardly, said ties are articulated at one end on said supports and at the other end are connected to respective slides by means of respective articulations located at one end of each of said slides, the slides being able to shift on guides located in respective lateral faces of the protruding element of the following car connected to the coupling or articulation;

the following car has two supports fixed to its bed and close to its front contour symmetrically with respect to the longitudinal axis of said car, from which corresponding ties emerge forwardly, which ties are articulated at one end on said supports and at the other end are connected to respective support parts by means of respective articulations, each of the support parts having a protruding stop on its outer face and elastic means connecting each support part with the corresponding lateral face of the protrusion of the following car;

and the support parts have an inner face in the form of an inclined plane and the slides are wedge-shaped with their outer face having the same inclination as that of the inner face of the support part, such that the inclined plane corresponding to the inner face of each support part is coupled to a guide located in the inclined plane of the outer face of the corresponding slide, such that each slide can shift along the inclined plane of the inner face of the respective support part.

3. The device for shifting the stops of articulated cars of railway vehicles in curves according to claim 2, wherein the elastic means are springs.

4. The device for shifting the stops (3) of articulated cars (6, 6') of railway vehicles in curves according to claim 2, wherein the support parts (1) are U-shaped.

5. A device for shifting the stops of articulated cars of railway vehicles in curves, which is arranged between every two contiguous cars articulated by means of a transversely centered coupling or articulation, the two contiguous cars being a preceding car and a following car and having a protruding element protruding from a front part connected to the coupling or articulation projecting from a rear part of the preceding car, wherein the preceding car has two rods integral therewith and projecting from its rear part symmetrically with respect to its longitudinal axis;

on respective lateral faces of the protruding element there are respective wedge-shaped slides able to shift on guides located in said lateral faces, said lateral faces comprising an end stop for the slide, each slide being supported by one of slide's end surfaces on an elastic means which is connected to front edge of the following car;

on the respective lateral faces of the protruding element there are respective support parts fixed to said faces, each of said support parts with an opening on an outer face housing a stop able to shift transversely, an inner surface of the stop having an inclination corresponding to that of an inclined plane of the outer surface of the wedge-shaped slide, the slides being able to shift inside the corresponding support parts;

and in that the rods have a length such that when the cars are aligned, said rods make contact on the corresponding end faces of the slides.

6. The device for shifting the stops of articulated cars of railway vehicles in curves according to claim 5, wherein the elastic means are springs.

7. The device for shifting the stops of articulated cars of railway vehicles in curves according to claim 5, wherein the support parts are U-shaped.

8. The device for shifting the stops of articulated cars of railway vehicles in curves according to claim 3, wherein the support parts are U-shaped.

9. The device for shifting the stops of articulated cars of railway vehicles in curves according to claim 6, wherein the support parts are U-shaped.

* * * * *